US009791884B2

(12) United States Patent
Konno et al.

(10) Patent No.: US 9,791,884 B2
(45) Date of Patent: Oct. 17, 2017

(54) ROTARY INPUT OPERATION DEVICE

(71) Applicant: ALPS ELECTRIC CO., LTD., Tokyo (JP)

(72) Inventors: Satoru Konno, Miyagi-ken (JP); Yeonjo Choi, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/087,572

(22) Filed: Mar. 31, 2016

(65) Prior Publication Data

US 2016/0306378 A1 Oct. 20, 2016

(30) Foreign Application Priority Data

Apr. 15, 2015 (JP) ..... 2015-083532

(51) Int. Cl.
*G05G 1/10* (2006.01)
*G05G 5/06* (2006.01)
*G05G 1/08* (2006.01)

(52) U.S. Cl.
CPC ..... *G05G 1/08* (2013.01); *G05G 1/10* (2013.01); *G05G 5/06* (2013.01)

(58) Field of Classification Search
CPC .. G05G 1/08; G05G 1/10; G05G 5/03; G05G 5/06; G05G 5/065; F16H 53/02; F16H 53/06; H03J 5/10; H03J 5/12; H03J 5/143; H03J 5/22; H03J 1/14; H01H 3/50
See application file for complete search history.

(56) References Cited

U.S. PATENT DOCUMENTS 3,359,383 A * 12/1967 Cryer ..... H01H 21/50 200/290
5,680,927 A * 10/1997 Thornton ..... H01H 21/50 200/565
5,969,588 A * 10/1999 Nelson ..... H02K 7/07 310/156.01
6,884,948 B2 * 4/2005 Gotoh ..... B60K 37/06 200/332
7,804,036 B2 * 9/2010 Ishigaki ..... B60K 37/06 200/336
2010/0024586 A1 * 2/2010 Heldmann ..... F16H 61/24 74/473.36

FOREIGN PATENT DOCUMENTS

CH WO 2016008929 A1 * 1/2016 ..... F16H 61/24
DE 3236531 A1 * 4/1984 ..... G05G 1/08
DE WO 2010057759 A1 * 5/2010 ..... F16H 59/70
JP 2001-202851 7/2001

* cited by examiner

*Primary Examiner* — Adam D Rogers
(74) *Attorney, Agent, or Firm* — Beyer Law Group LLP

(57) ABSTRACT

In a rotating operation body, a cam part has first cam faces for click feeling generation and second cam faces for return of the rotating operation body. The second cam faces are respectively formed continuously with the first cam faces, and an angle between each of the second cam faces and a direction in which elastic forces of engagement parts are generated is smaller than an angle of each of the first cam faces. That is, each of the second cam faces has a steeper slope than each of the first cam faces.

10 Claims, 9 Drawing Sheets

ROTARY INPUT OPERATION DEVICE

CLAIM OF PRIORITY

This application claims benefit of Japanese Patent Application No. 2015-083532 filed on Apr. 15, 2015, which is hereby incorporated by reference.

BACKGROUND OF THE INVENTION

1. Field of the Invention

The present invention relates to a rotary input operation device which performs input according to a rotating operation, and an input operation system which uses the rotary input operation device.

2. Description of the Related Art

There is a rotary input operation device in which input instructions corresponding to a rotation angle are performed by rotating a rotating operation part with the fingers or the like and a rotation return force is generated if a rotation angle of the rotating operation part exceeds a certain angle, and which has a self-return function of automatically returning to the original position when a rotating operation is released.

In such a rotary input operation device, a spring for generating a click feeling and a spring for self-return are individually provided.

Japanese Unexamined Patent Application Publication No. 2001-202851 is an example of related art.

However, in the rotary input operation device of the related art described above, the spring for generating a click feeling and the spring for self-return are individually provided, and therefore, there is a problem in that the number of parts is increased, thereby causing a larger scale, and a manufacturing process is complicated.

Further, there is a request to want to realize different click feelings with a small number of parts at a rotary input operation.

SUMMARY OF THE INVENTION

The present invention provides a rotary input operation device and an input operation system, in which different click feelings in a rotating operation can be realized with a small number of parts.

Further, the present invention provides a rotary input operation device and an input operation system, in which a click feeling generation function according to a rotating operation and an automatic return function in a case where a rotating operation force is released can be realized with a small number of parts.

According to an aspect of the present invention, there is provided a rotary input operation device including: a cam part having a cam face; and an engagement part which is pressed against the cam face by an elastic force and generates a click feeling by rotating while sliding relative to the cam face according to a rotating operation, in which the cam part has a plurality of the cam faces in which angles between the cam faces and a direction in which the elastic force acts are different from each other.

According to this configuration, the cam part has the plurality of cam faces in which angles between the cam faces and a direction in which the elastic force acts are different from each other, and therefore, due to the different angles, different click feelings can be realized with a small number of parts by a pair of engagement parts and the cam part. For this reason, a reduction in scale and simplification of a manufacturing process can be attained.

Preferably, the rotary input operation device according to the above aspect of the present invention further includes: a first cam face for click feeling generation; and a second cam face in which an angle between the second cam face and the direction in which the elastic force acts is smaller than an angle of the first cam face, and which returns to a position where the engagement part is pressed, toward the first cam face, when a rotating operation force is released.

According to this configuration, a click feeling generation function according to a rotating operation and an automatic return function in a case where a rotating operation force is released can be realized by a pair of engagement parts and the cam part, and therefore, the number of parts can be reduced.

Preferably, the second cam face of the rotary input operation device according to the above aspect of the present invention has a third cam face which is located on the first cam face side, and a fourth cam face which is located on the side opposite to the first cam face with respect to the third cam face and in which an angle between the fourth cam face and the direction in which the elastic force acts is smaller than an angle of the third cam face.

According to this configuration, the angle of the fourth cam face which is close to the maximum rotation angle is small, and therefore, a strong rotating operation force is required at the portion, and proximity to the maximum rotation angle can be transmitted as a sense of an operator's finger. Further, a strong rotating force toward the first cam face is generated in the vicinity of the maximum rotation angle, whereby a return operation when a rotating operation is released can be performed at high speed.

Preferably, in the rotary input operation device according to the above aspect of the present invention, an end portion on the side opposite to the third cam face, of the fourth cam face, is in the vicinity of a maximum rotational position of the rotating operation, and the engagement part is pressed against the cam face with the strongest elastic force at the maximum rotational position.

According to this configuration, a rotating operation force at the maximum rotation angle becomes the maximum, and thus a return operation can be performed at high speed.

Preferably, the rotary input operation device according to the above aspect of the present invention further includes: a plurality of fixed contacts provided at a substrate; and a movable contact which rotates together with the cam part and slides on the fixed contact, in which the first cam face forms a valley portion which holds the engagement part at a position where the movable contact comes into contact with the fixed contact.

According to this configuration, it is possible to stably position the movable contact at the position of the fixed contact.

Preferably, the rotary input operation device according to the above aspect of the present invention further includes: a first engagement part; and a second engagement part, in which two first cam faces, in which the first engagement part is pressed against the first cam face on one side and the second engagement part is pressed against the first cam face on the other side, are provided point-symmetrically with respect to a rotation center of the rotating operation, and two second cam faces, in which the first engagement part is pressed against the second cam face on one side and the second engagement part is pressed against the second cam face on the other side, are provided point-symmetrically with respect to the rotation center of the rotating operation.

According to this configuration, a rotational balance of a rotating operation body is improved, and thus the rotating operation body can smoothly rotate, and a load to each member is dispersed, thereby being able to exhibit high durability.

Preferably, the rotary input operation device according to the above aspect of the present invention further includes a rotating operation body which is provided with the cam part and rotates according to a rotating operation.

According to another aspect of the present invention, there is provided an input operation system including: the rotary input operation device described above; and an input operation case which accommodates the rotating operation body and the engagement part, in which the engagement part is fixed to the input operation case.

DESCRIPTION OF THE PREFERRED EMBODIMENTS

Hereinafter, a pressing operation device according to an embodiment of the present invention will be described.

Figure 1:
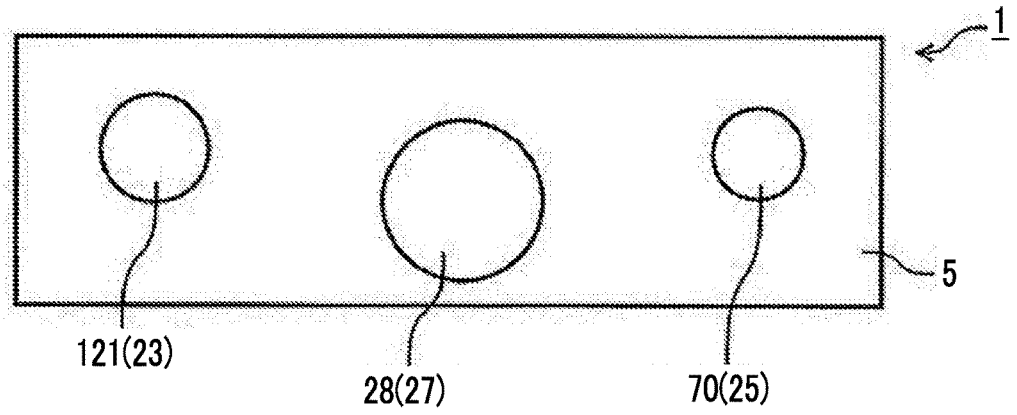
FIG. 1 is a plan view of an input operation system 1 of an embodiment of the present invention.
Figure 2:
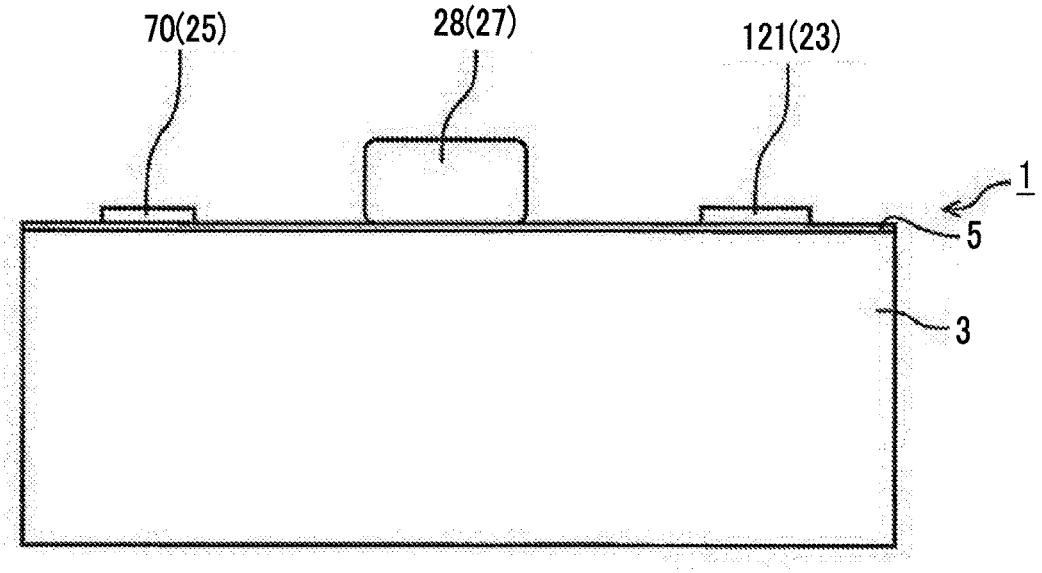
FIG. 2 is a diagram for describing a configuration on the front side in a state where a rotary input operation device is accommodated in an input operation case.

FIG. 1 is a plan view of an input operation system 1 of this embodiment, and FIG. 2 is a diagram for describing a configuration on the front side in a state where a rotary input operation device 27 is accommodated in an input operation case 3.

As shown in FIGS. 1 and 2, the input operation system 1 is disposed at, for example, the side or the like of a steering wheel of a driver's seat of a vehicle and configured by accommodating a pressing operation device 23 which adjusts, for example, the brightness of an external lighting such as a headlight, a linear operation body 25 for performing an on/off operation of a fog lamp or the like, and the rotary input operation device 27 for performing an on/off operation of the headlight in the input operation case 3.

A pressing operation part 121 of the pressing operation device 23, an operation part 70 of the linear operation body 25, and a rotating operation part 28 of the rotary input operation device 27 appear at a front panel plate 5 which is located on the front side of the input operation system 1.

Hereinafter, the rotary input operation device 27 will be described in detail.

Figure 3:
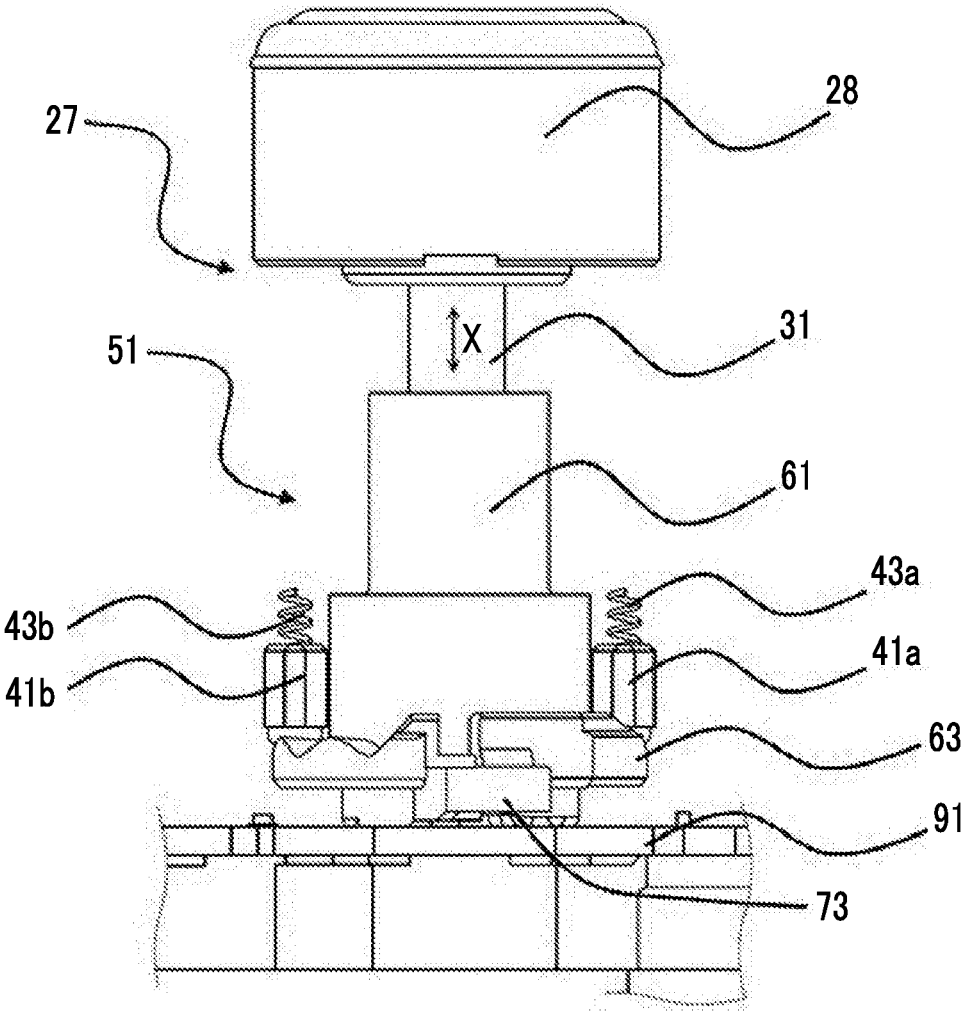
FIG. 3 is an appearance diagram when viewed in a side view of a rotary input operation device according to the embodiment of the present invention and a rotating operation body.

FIG. 3 is an appearance diagram when viewed in a side view of the rotary input operation device 27.

As shown in FIG. 3, the rotary input operation device 27 has the rotating operation part 28, a support part 31, engagement parts 41*a* and 41*b*, springs 43*a*, and 43*b*, and a rotating operation body 51.

The rotating operation body 51 has a central holding part 61 and a cam part 63. The holding part 61 and the cam part 63 are molded in an integrated fashion, for example.

The holding part 61 has an opening portion at the center, and the support part 31 is inserted and fixed into the opening portion.

The rotating operation part 28 is fixed to the tip of the support part 31.

If the rotating operation part 28 is rotationally operated with the fingers or the like, the support part 31 and the rotating operation body 51 rotate together with the rotating operation part 28.

The cam part 63 has cam faces against which the engagement parts 41*a* and 41*b* are pressed by elastic forces by the springs 43*a* and 43*b*. If the rotating operation body 51 rotates according to a rotating operation force, as will be described later, the engagement parts 41*a* and 41*b* slide relative to the cam faces and transmit a rotational load according to the concavity and convexity of the cam faces to the rotating operation part 28, thereby giving a click feeling to the fingers or the like of an operator.

The cam part 63 has a plurality of cam faces in which the angles between the cam faces and a direction X in which the elastic forces of the springs 43*a* and 43*b* act are different from each other. In this way, due to the cam part 63 and the engagement parts 41*a* and 41*b*, it is possible to generate various operational feelings with fewer parts.

Figure 4:
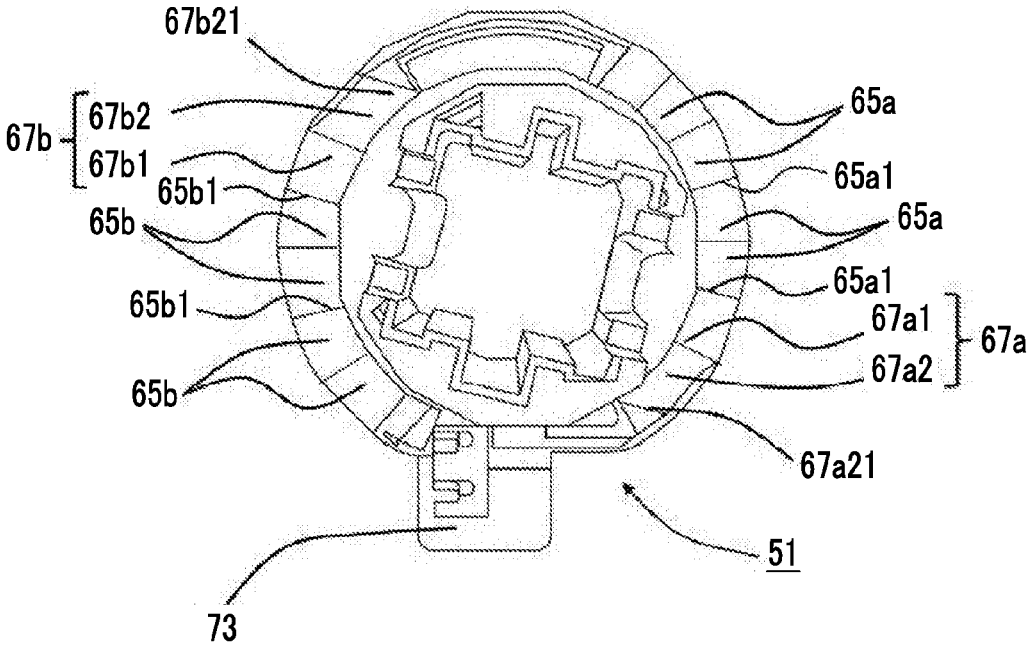
FIG. 4 is an appearance diagram when viewed in a plan view of the rotating operation body shown in FIG. 3.

FIG. 4 is an appearance diagram when viewed in a plan view of the rotating operation body 51 shown in FIG. 1.

Specifically, as shown in FIG. 4, the cam part 63 has first cam faces 65*a* and 65*b* for click feeling generation, and second cam faces 67*a* and 67*b* for return (self-return) of the rotating operation body 51.

Figure 5:
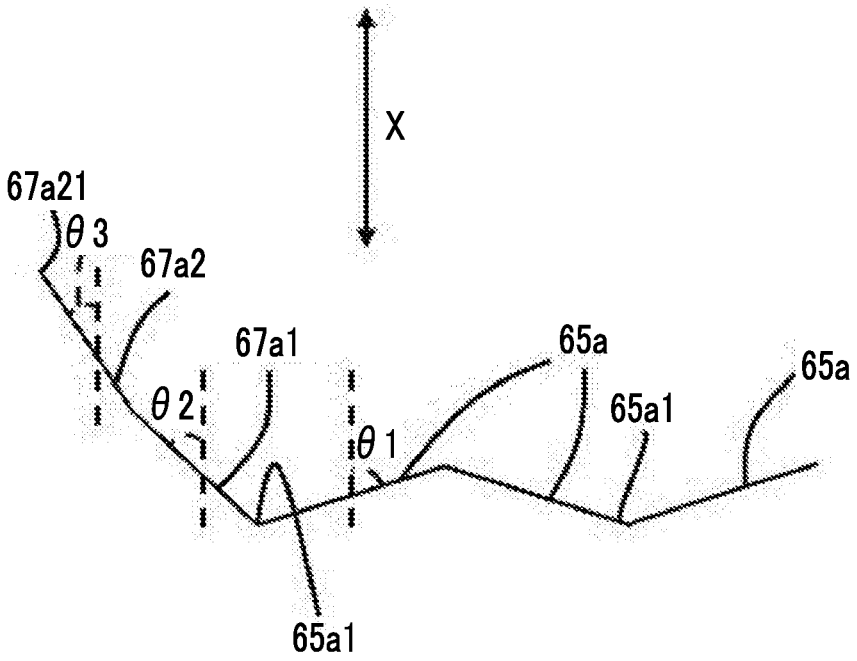
FIG. 5 is a diagram for describing inclination angles of cam faces of a cam part.

FIG. 5 is a diagram for describing the inclination angles of the cam faces of the cam part 63.

Each of the first cam faces 65*a* and 65*b* is formed in a plurality in succession.

Valley portions 65*a*1 and 65*b*1 holding the engagement parts 41*a* and 41*b* are formed between the adjacent first cam faces 65*a* and 65*b* and between the first cam faces 65*a* and 65*b* and the second cam faces 67*a* and 67*b* (described later). The engagement parts 41*a* and 41*b* are held in the valley portions 65*a*1 and 65*b*1, whereby the rotating operation part 28 is positioned at a predetermined rotation angle.

The second cam faces 67*a* and 67*b* are respectively formed continuously with the first cam faces 65*a* and 65*b*, and as shown in FIG. 5, an angle θ2 between each of the second cam faces 67*a* and 67*b* and the X-direction is smaller than an angle θ1 of each of the first cam faces 65*a* and 65*b*. That is, each of the second cam faces 67*a* and 67*b* has a steeper slope than the first cam faces 65*a* and 65*b*.

Figure 6:
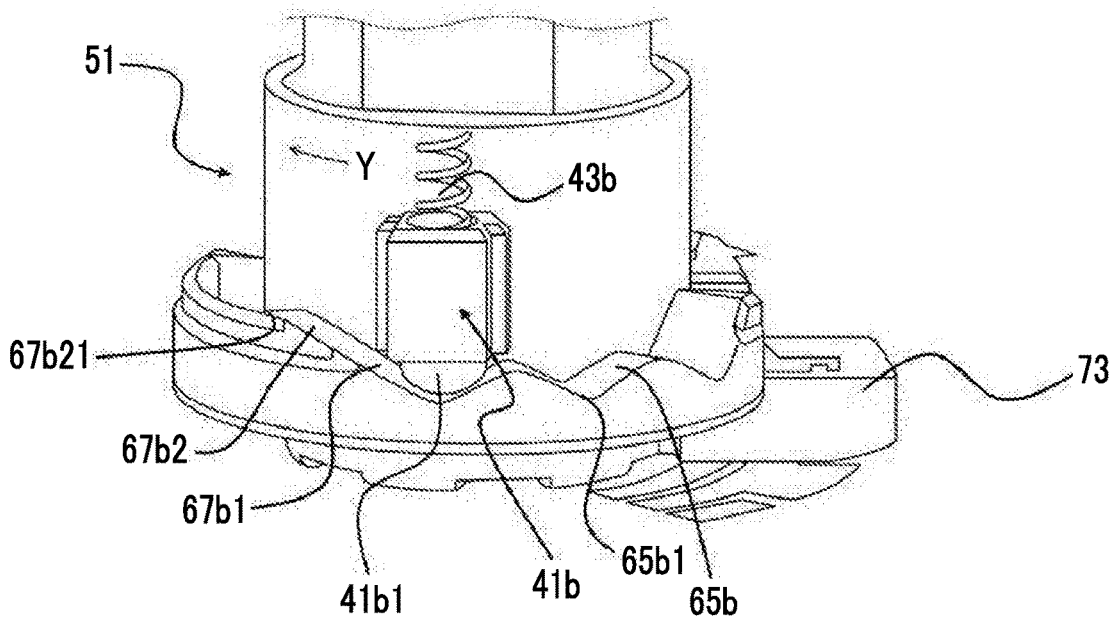
FIG. 6 is a diagram for describing a return operation of the rotary input operation device according to the embodiment of the present invention.

If the rotating operation body 51 is rotated, whereby the engagement parts 41*a* and 41*b* are pressed against the second cam faces 67*a* and 67*b*, the engagement parts 41*a* and 41*b* press the second cam faces 67*a* and 67*b* from a direction of the angle θ2. For this reason, a rotating force is generated in a direction to return the rotation of the rotating operation body 51. Then, in this state, if the rotating operation force is released, the rotating operation body 51 rotates and returns toward the positions of the first cam faces 65*a* and 65*b* (FIG. 6). At this time, the smaller the angle θ2, the larger the return rotating force becomes.

The second cam faces 67*a* and 67*b* respectively have third cam faces 67*a*1 and 67*b*1 and fourth cam faces 67*a*2 and 67*b*2.

The third cam faces 67*a*1 and 67*b*1 are respectively located on the sides of the first cam faces 65*a* and 65*b*. An angle between each of the third cam faces 67*a*1 and 67*b*1 and the X-direction is θ2.

The fourth cam faces 67*a*2 and 67*b*2 are located on the sides opposite to the first cam faces 65*a* and 65*b* with respect to the third cam faces 67*a*1 and 67*b*1, and an angle between each of the fourth cam faces 67*a*2 and 67*b*2 and the X-direction is θ3 which is smaller than θ2.

End portions 67*a*21 and 67*b*21 on the sides opposite to the third cam faces 67*a*1 and 67*b*1, of the fourth cam faces 67*a*2 and 67*b*2, are in the vicinity of the maximum rotation position of the rotating operation part 28. If the rotating operation part 28 reaches the maximum rotation position, a state is created where the springs 43*a* and 43*b* are most reduced in the X-direction. In this way, the engagement parts 41*a* and 41*b* are pressed against the second cam faces 67*a* and 67*b* with the strongest elastic force.

One end of each of the springs 43*a* and 43*b* is fixed to each of the engagement parts 41*a* and 41*b*. The other end of each of the springs 43*a* and 43*b* is fixed to the input operation case 3.

Guide portions which guide the movements in the X-direction of the engagement parts 41*a* and 41*b* are formed in the interior of the input operation case 3.

If the rotating operation body 51 rotates according to the rotating operation force, the engagement parts 41*a* and 41*b* slide relative to the first cam faces 65*a* and 65*b*, thereby causing a click feeling. The engagement parts 41*a* and 41*b* have convex portions 41*a*1 and 41*b*1, each of which has a curved surface at the tip thereof, as shown in FIG. 6 and the like, and the convex portions 41*a*1 and 41*b*1 are pressed against the first cam faces 65*a* and 65*b*.

Further, the convex portions 41*a*1 and 41*b*1 of the engagement parts 41*a* and 41*b* are pressed against the second cam faces 67*a* and 67*b* in the vicinity of the maximum rotation position of the rotating operation part 28.

In this embodiment, the first cam face 65*a* and the first cam face 65*b*, the third cam face 67*a*1 and the third cam face 67*b*1, the fourth cam face 67*a*2 and the fourth cam face 67*b*2, and the engagement part 41*a* and the engagement part 41*b* are disposed point-symmetrically with respect to the rotation center of the rotating operation body 51.

Due to such point-symmetrical disposition, the rotational balance of the rotating operation body 51 is improved, and thus the rotating operation body 51 can smoothly rotate, and a load to each member is dispersed, thereby being able to exhibit high durability.

As shown in FIGS. 3, 4, and 6, and the like, a stopper 73 is provided at a predetermined position of the outer periphery of the cam part 63.

Further, a movable contact electrode 75 is provided on the substrate 91 side of the stopper 73.

If the rotating operation body 51 is rotationally operated, the movable contact electrode 75 rotates together with the rotating operation body 51.

Figure 7:
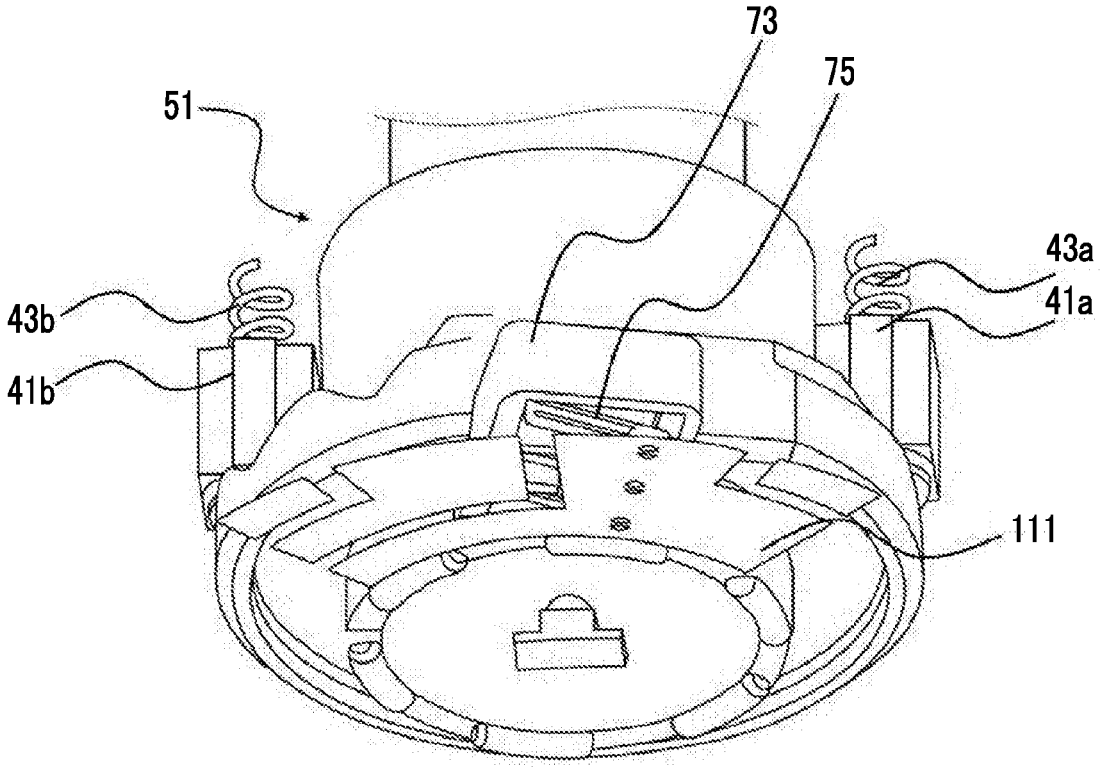
FIG. 7 is a perspective view for describing a movable contact electrode and a fixed contact electrode of the rotating operation body shown in FIG. 1.

FIG. 7 is a perspective view for describing the movable contact electrode 75 and a fixed contact electrode 111 of the rotating operation body shown in FIG. 3.

As shown in FIG. 7, a plurality of fixed contact electrodes 111 are formed at the substrate 91 shown in FIG. 3.

The rotational position of the rotating operation body 51 is detected by the positional relationship between the movable contact electrode 75 and the plurality of fixed contact electrodes 111.

That is, if the rotating operation body 51 rotates, the movable contact electrode 75 slides on the fixed contact electrode 111 together with the rotating operation body 51.

The engagement parts 41*a* and 41*b* are held by the valley portions 65*a*1 and 65*b*1 of the first cam faces 65*a* and 65*b*, whereby the movable contact electrode 75 is positioned so as to come into contact with the individual fixed contact electrode 111.

Figure 8:
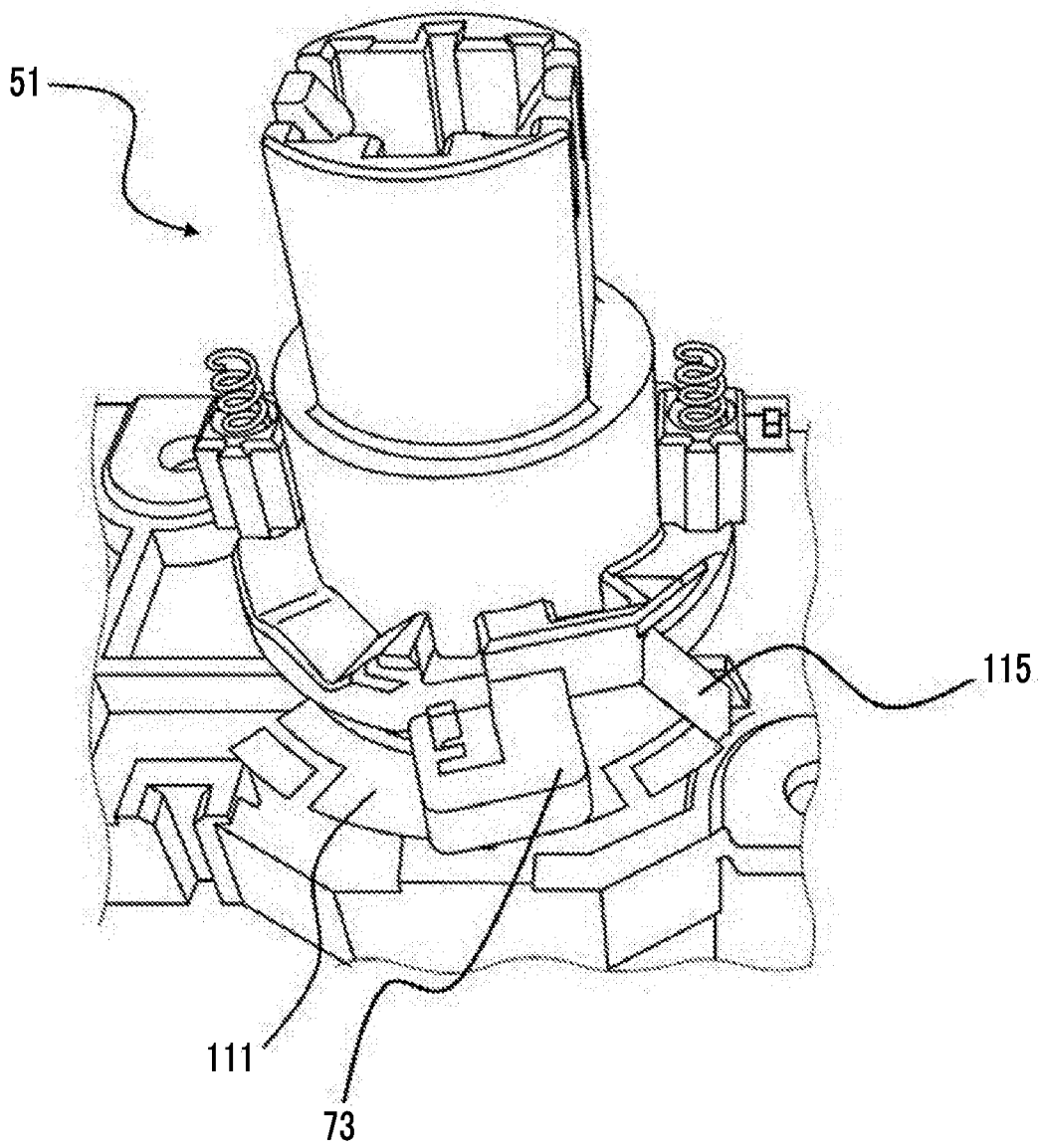
FIG. 8 is a perspective view for describing a rotation stop mechanism of the rotating operation body according to the embodiment of the present invention.

FIG. 8 is a perspective view for describing a rotation stop mechanism of the rotating operation body 51.

As shown in FIG. 8, a stopper 115 is provided at the input operation case 3.

If the rotating operation body 51 reaches the maximum rotation angle, whereby the engagement parts 41*a* and 41*b* reach the end portions 67*a*21 and 67*b*21 of the fourth cam faces 67*a*2 and 67*b*2, the stopper 73 of the rotating operation body 51 is stopped by touching the stopper 115 of the input operation case 3. In this way, the rotation of the rotating operation body 51 is restricted.

Hereinafter, operation examples of the rotary input operation device 27 will be described.

First Operation Example

In this operation example, an operation of adjusting the brightness of a headlight will be described.

An operator rotationally operates the rotating operation part 28 shown in FIG. 3 with the fingers or the like. Then, if the rotating operation body 51 rotates, the convex portions 41*a*1 and 41*b*1 of the engagement parts 41*a* and 41*b* slide in a state of being pressed against the first cam faces 65*a* and 65*b* of the cam part 63, whereby a rotational load according to the concavities and convexities of the first cam faces 65*a* and 65*b* is transmitted to the fingers or the like of the operator as a click feeling through the rotating operation part 28.

Further, the engagement parts 41*a* and 41*b* are held by the valley portions of the first cam faces 65*a* and 65*b* corresponding to the rotational position of the rotary input operation device 27, and the movable contact electrode 75 comes into contact with the fixed contact electrode 111 corresponding thereto. Then, the rotational position is detected by an electrical signal which is generated according to the contact position, and the headlight is adjusted to the brightness corresponding to the rotational position.

Second Operation Example

In this operation example, an operation of turning on and off an automatic function of a headlight will be described.

An operator rotationally operates the rotating operation part 28 shown in FIG. 3 with the fingers or the like to the vicinity of the maximum rotational positions of the end portions 67*a*21 and 67*b*21 of the second cam faces 67*a* and 67*b* in a direction of an arrow Y shown in FIG. 6.

In this way, the movable contact electrode 75 comes into contact with the fixed contact electrode 111 corresponding to the maximum rotational position. Then, a rotational position is detected by an electrical signal which is generated according to the contact position, and the automatic function of the headlight is switched on and off.

Here, in a state where the rotating operation body 51 is in the vicinity of the maximum rotational position, that is, the engagement parts 41*a* and 41*b* are pressed against the fourth cam faces 67*a*2 and 67*b*2, the engagement parts 41*a* and 41*b* press the second cam faces 67*a* and 67*b* from a direction of the angle θ3. For this reason, a rotating force is generated in a direction to return the rotation of the rotating operation body 51. Then, in this state, if a rotating operation force is released, the rotating operation body 51 automatically rotates and returns toward the first cam faces 65*a* and 65*b* (FIG. 6).

As described above, according to the rotary input operation device 27, the first cam faces 65*a* and 65*b*, the third cam faces 67*a*1 and 67*b*1, and the fourth cam faces 67*a*2 and 67*b*2, in which the angles between them and the X-direction in which the elastic forces of the springs 43*a* and 43*b* act are different from each other, are formed in the cam part 63, whereby it is possible to generate various operational feelings with fewer parts. For this reason, a reduction in scale is possible and a manufacturing process can be simplified.

Further, according to the rotary input operation device 27, both a click feeling generation function and a return function of an on/off operation of an automatic function can be realized by the engagement parts 41*a* and 41*b* and the cam faces of the rotating operation body 51. For this reason, compared to a case where these functions are realized with individual members, the number of parts is reduced, a reduction in scale is possible, and a manufacturing process can be simplified.

Further, in the rotary input operation device 27, the angle θ3 between the X-direction and each of the fourth cam faces 67*a*2 and 67*b*2 is set to be smaller than the angle θ2 between the X-direction and each of the third cam faces 67*a*1 and 67*b*1.

In this way, the strongest rotating operation force is required when the engagement parts 41*a* and 41*b* are pressed against the fourth cam faces 67*a*2 and 67*b*2, and thus proximity to the maximum rotation angle can be transmitted as a sense of an operator's finger. Further, a strong rotating force can be generated in the vicinity of the maximum rotation angle, and thus a return operation when the rotating operation is released can be performed at high speed. As a result, stopping due to being caught at a place where the initial rotational speed is low can be prevented.

Further, in the rotary input operation device 27, the first cam face 65*a* and the first cam face 65*b*, the third cam face 67*a*1 and the third cam face 67*b*1, the fourth cam face 67*a*2 and the fourth cam face 67*b*2, and the engagement part 41*a* and the engagement part 41*b* are disposed point-symmetrically with respect to the rotation center of the rotating operation body 51.

For this reason, the rotational balance of the rotating operation body 51 is improved, and thus the rotating operation body 51 can smoothly rotate, and a load to each member is dispersed, thereby being able to exhibit high durability.

The present invention is not limited to the embodiment described above.

That is, a person skilled in the art may perform various changes, combinations, sub-combinations, and substitution with respect to the constituent elements of the above-described embodiment within the technical scope of the present invention or a scope equivalent thereto.

Figure 9:
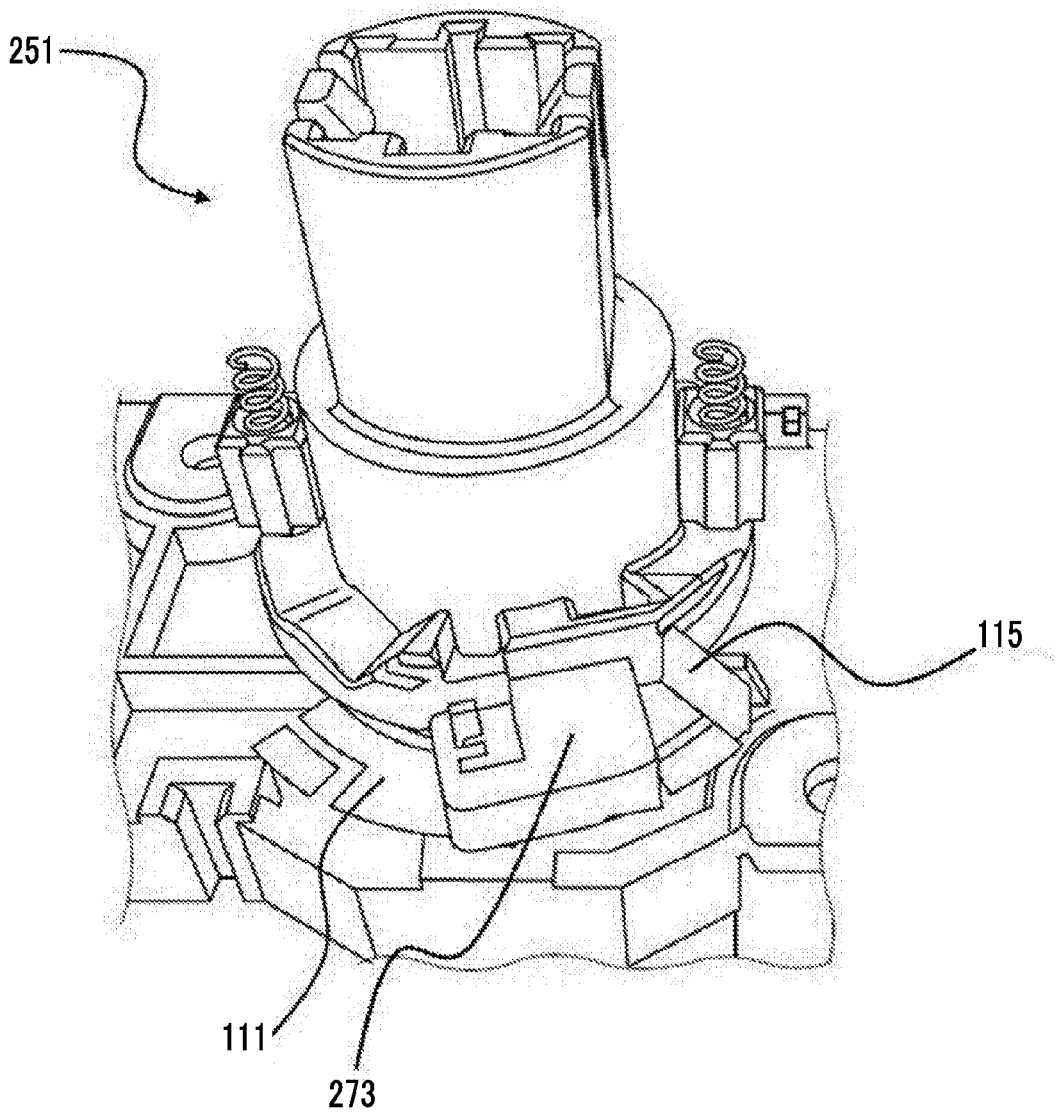
FIG. 9 is a perspective view for describing a rotation stop mechanism of a rotating operation body according to another embodiment of the present invention.

FIG. 9 is a perspective view for describing a stopper mechanism of a rotating operation body 251 of another embodiment.

As shown in FIG. 9, in a rotary input operation device of this embodiment, the length in a circumferential direction of a stopper 273 of the rotating operation body 251 is longer than the stopper 73. In this way, before the engagement parts 41*a* and 41*b* rotate to the positions of the second cam faces 67*a* and 67*b*, the stopper 273 is stopped by touching the stopper 115.

By using the rotating operation body 251 instead of the rotating operation body 51, it is also possible to easily cope with a model without an automatic function.

Further, the shape or the like of a member configuring the rotary input operation device 27 described in this embodiment is one example and can be modified.

The present invention can be applied to a rotary input operation device which is provided at the periphery or the like of a driver's seat of a vehicle.

It should be understood by those skilled in the art that various modifications, combinations, sub-combinations and alterations may occur depending on design requirements and other factors insofar as they are within the scope of the appended claims of the equivalents thereof.

What is claimed is:

1. A rotary input operation device comprising:

a cam part having a cam surface; and an engagement member configured to be pressed against the cam surface by an elastic force applied in a first direction and to generate a click feeling by sliding along the cam surface according to a rotating operation of the rotary input operation device, wherein the cam surface includes a plurality of cam faces which have different angles with respect to the first direction, the plurality of cam faces comprising:

first cam faces configured to generate the click feeling, the first cam faces forming first angles with the first direction; and second cam faces forming second angles with the first direction, the second angles being smaller than the first angles, the second cam faces being configured to return a position of the engagement member toward the first cam faces when a rotating operation force is released, the second cam faces including:

a third cam face located next to the first cam faces; and a fourth cam face located next to the third cam face on an opposite side of the first cam faces, the fourth cam face having one of the second angles be smaller than another one of the second angles formed on the third cam face.

2. The rotary input operation device according to claim 1, wherein an end portion of the second cam faces on the opposite side of the first cam faces is located in a vicinity of a maximum rotational position of the rotating operation, and the elastic force pressing the engagement member against the cam face is strongest at the maximum rotational position.

3. The rotary input operation device according to claim 1, further comprising:

a rotating operation body having a central holding part and the cam part, the rotating operation body being configured to rotate according to the rotating operation.

4. An input operation system comprising:

the rotary input operation device according to claim 1, the rotary input operation device further including a rotating operation body having the cam part; and an input operation case which accommodates the rotating operation body and the engagement member, wherein the engagement member is fixed to the input operation case.

5. A rotary input operation device comprising:

a cam part having a cam surface;

an engagement member configured to be pressed against the cam surface by an elastic force applied in a first direction and to generate a click feeling by sliding along the cam surface according to a rotating operation of the rotary input operation device;

a plurality of fixed contacts provided on a substrate; and a movable contact configured to rotate together with the cam part and slide along the fixed contacts, wherein the cam surface includes a plurality of cam faces which have different angles with respect to the first direction, the plurality of first cam faces having a valley portion formed by adjacent two of the first cam faces so as to hold the engagement member at a position where the movable contact comes into contact with a corresponding one of the fixed contacts.

6. The rotary input operation device according to claim 5, further comprising:

a rotating operation body having a central holding part and the cam part, the rotating operation body being configured to rotate according to the rotating operation.

7. An input operation system comprising:

the rotary input operation device according to claim 5, the rotary input operation device further including a rotating operation body having the cam part; and an input operation case which accommodates the rotating operation body and the engagement member, wherein the engagement member is fixed to the input operation case.

8. A rotary input operation device comprising:

a cam part having a cam surface;

an engagement member configured to be pressed against the cam surface by an elastic force applied in a first direction and to generate a click feeling by sliding along the cam surface according to a rotating operation of the rotary input operation device, the engagement member including:

a first engagement part; and a second engagement part provided at a position point-symmetrical to the first engagement part with respect to a rotation axis of the rotating operation, wherein the cam surface includes a plurality of first and second cam faces which have different angles with respect to the first direction, wherein the first cam faces include:

a first portion of the first faces provided for the first engagement part; and a second portion of the first faces provided for the second engagement part at a position point-symmetrical to the first portion of the first faces with respect to the rotation axis, and wherein the second cam faces include:

a first portion of the second faces provided for the first engagement part; and a second portion of the second faces provided for the second engagement part at a position point-symmetrical to the first portion of the second faces with respect to the rotation axis.

9. The rotary input operation device according to claim 8, further comprising:

a rotating operation body having a central holding part and the cam part, the rotating operation body being configured to rotate according to the rotating operation.

10. An input operation system comprising:

the rotary input operation device according to claim 8, the rotary input operation device further including a rotating operation body having the cam part; and an input operation case which accommodates the rotating operation body and the engagement member, wherein the engagement member is fixed to the input operation case.

* * * * *